US006708655B2

(12) United States Patent
Maloney et al.

(10) Patent No.: US 6,708,655 B2
(45) Date of Patent: Mar. 23, 2004

(54) VARIABLE COMPRESSION RATIO DEVICE FOR INTERNAL COMBUSTION ENGINE

(75) Inventors: Ronald P. Maloney, Peoria, IL (US); James J. Faletti, Spring Valley, IL (US)

(73) Assignee: Caterpillar Inc, Peoria, IL (US)

( * ) Notice: Subject to any disclaimer, the term of this patent is extended or adjusted under 35 U.S.C. 154(b) by 39 days.

(21) Appl. No.: 10/122,560

(22) Filed: Apr. 15, 2002

(65) Prior Publication Data

US 2003/0192490 A1 Oct. 16, 2003

(51) Int. Cl.[7] ..... F02B 75/04
(52) U.S. Cl. ..... 123/48 A
(58) Field of Search ..... 123/48 A, 48 AA, 123/536, 538, 537, 48 R, 48 B

(56) References Cited

U.S. PATENT DOCUMENTS

| | | | | |
|---|---|---|---|---|
| 2,080,720 A | 5/1937 | Jahnke | 123/48 |
| 2,599,908 A | 6/1952 | Gehrandt | 123/32 |
| 2,914,047 A | 11/1959 | Colton | 123/48 |
| 2,970,581 A | 2/1961 | Georges | 123/48 |
| 3,741,175 A | 6/1973 | Rouger | 123/48 |
| 4,168,678 A | 9/1979 | Nohira et al. | 123/30 |
| 4,516,537 A | 5/1985 | Nakahara et al. | 123/48 |
| 4,539,946 A | 9/1985 | Hedelin | 123/48 |
| 4,860,711 A | 8/1989 | Morikawa | 123/48 |
| 4,987,863 A | 1/1991 | Daly | 123/48 |
| 5,024,184 A | 6/1991 | Nagano et al. | 123/48 |
| 6,450,154 B1 * | 9/2002 | Choi | 123/536 |

* cited by examiner

*Primary Examiner*—Tony M. Argenbright
*Assistant Examiner*—Hyder Ali
(74) *Attorney, Agent, or Firm*—Todd T Taylor

(57) ABSTRACT

An internal combustion engine, particularly suitable for use in a work machine, is provided with a combustion cylinder, a cylinder head at an end of the combustion cylinder and a primary piston reciprocally disposed within the combustion cylinder. The cylinder head includes a secondary cylinder and a secondary piston reciprocally disposed within the secondary cylinder. An actuator is coupled with the secondary piston for controlling the position of the secondary piston dependent upon the position of the primary piston. A communication port establishes fluid flow communication between the combustion cylinder and the secondary cylinder.

20 Claims, 2 Drawing Sheets

VARIABLE COMPRESSION RATIO DEVICE FOR INTERNAL COMBUSTION ENGINE

The Government of the United States of America has rights in this invention pursuant to Contract No. DE-FC05-970R22605 (LTCD) awarded by the U.S. Department of Energy.

TECHNICAL FIELD

The present invention relates generally to the field of internal combustion engines, and more specifically to engines operated under homogenous charge compression ignition principles and piston arrangements therefor.

BACKGROUND

An internal combustion engine combusts a fuel and air mixture within one or more combustion cylinders, and converts the energy from the combustion process into mechanical output energy. It has been known for many years to use spark ignition and combustion ignition concepts in internal combustion engines. In spark ignition engines, a mixture of fuel and air is provided to a combustion cylinder and compressed. A spark plug initiates combustion through the creation of an open spark sufficient to ignite the air and fuel mixture in the cylinder. Both two and four stroke operating sequences are known.

In a direct injection combustion ignition engine, such as a diesel engine, it also is common to use both two and four stroke operating sequences. Turbochargers are often used to supply a charge of air to the combustion cylinders at higher pressure and density than existing ambient conditions. On an upward stroke of the cylinder, the air intake ports are closed and the air is highly compressed. At the desired level of compression, fuel is sprayed into the cylinder by a fuel injector. The fuel ignites immediately, as a result of the heat and pressure inside the cylinder. The pressure created by the combustion of the fuel drives the piston downward in the power stroke of the engine.

Engine emission standards have led to the investigation of engine operating and compression ignition alternatives. In one such alternative, referred to as homogenous charge compression ignition (HCCI), significant reductions in emissions have been experienced during initial testing. In an engine operating under HCCI concepts, the air and fuel are intimately mixed, typically at a high air/fuel ratio, before maximum compression in the combustion cylinder. As a result, each droplet of fuel is surrounded by a quantity of combustion air in excess of that required for combustion. As compression occurs, the air temperature increases, and ultimately combustion is initiated at numerous locations throughout the cylinder. Typically, combustion commences at lower temperatures than for direct charge ignition, leading to reduced NOx emissions.

The use of homogenous charge compression ignition concepts has apparent benefits in substantial reduction of NOx emissions. However, two aspects of combustion control, used regularly in more conventional engines, are not available in an HCCI engine. The timing of ignition in an HCCI engine can be controlled neither indirectly by controlling the start of fuel injection, as in a direct injection engine, nor directly by controlling spark initiation, as in a spark ignition engine. Further, the rate of heat release can not be controlled via control of fuel injection, as in a direct injection engine, nor by flame propagation, as in a spark ignition engine. As a result, ongoing efforts for improving the HCCI concept include ways to control the ignition event in an HCCI engine.

To overcome these problems, attempts have been made to control the compression ratio in the combustion cylinder using a secondary cylinder in communication with the combustion cylinder. By varying the position and movement of a secondary piston in the secondary cylinder, the compression ratio in the combustion cylinder can be controlled. However, fully open secondary cylinders occupy significant space on the bottom deck of the cylinder head, making the placement, arrangement and operation of the standard aspiration valves more difficult.

U.S. Pat. No. 4,516,537 entitled, "A Variable Compression System For Internal Combustion Engines" discloses a spark ignition engine in which a secondary cylinder and piston are provided to vary the compression ratio and reduce knock at low speeds and/or heavy loads, while also increasing power and fuel efficiency at high speed and/or light loads.

The present invention is directed to overcoming one or more of the problems as set forth above.

SUMMARY OF THE INVENTION

In one aspect of the invention, an internal combustion engine is provided with a combustion cylinder having an end, and a primary piston reciprocally disposed within the combustion cylinder. A cylinder head including a bottom deck at the end of the combustion cylinder. The cylinder head includes a secondary cylinder. A secondary piston is reciprocally disposed within the secondary cylinder. An actuator is coupled with the secondary piston for controlling a position of the secondary piston dependent upon a position of the primary piston, and thereby controlling commencement of a combustion event in the combustion cylinder. A communication port defined in the cylinder head establishes fluid flow communication between the combustion cylinder and the secondary cylinder.

In another aspect of the invention, a work machine is provided with a frame and an internal combustion engine carried by the frame. The internal combustion engine includes a combustion cylinder having an end, and a primary piston reciprocally disposed within the combustion cylinder. A cylinder head including a bottom deck at the end of the combustion cylinder. The cylinder head includes a secondary cylinder. A secondary piston is reciprocally disposed within the secondary cylinder. An actuator is coupled with the secondary piston for controlling a position of the secondary piston dependent upon a position of the primary piston, and thereby controlling commencement of a combustion event in the combustion cylinder. A communication port defined in the cylinder head establishes fluid flow communication between the combustion cylinder and the secondary cylinder.

In a further aspect of the invention, a method for operating an internal combustion engine is provided with steps of reciprocating a primary piston within a combustion cylinder having an end; reciprocating a secondary piston within a secondary cylinder adjacent the end, the reciprocating step being carried out such that the secondary piston has a position within the secondary cylinder which is dependent upon a position of the primary piston within the combustion cylinder; providing a combustable fuel to the combustion cylinder; communicating fluid flow between the secondary cylinder and the combustion cylinder, the communicating fluid flow step being carried out through a communication port having an opening in the combustion chamber and an opening in the secondary chamber, each the openings being narrower than the cylinders; and controlling commencement of a combustion event in the combustion cylinder through control of the position of the secondary piston.

DETAILED DESCRIPTION

Figure 1:
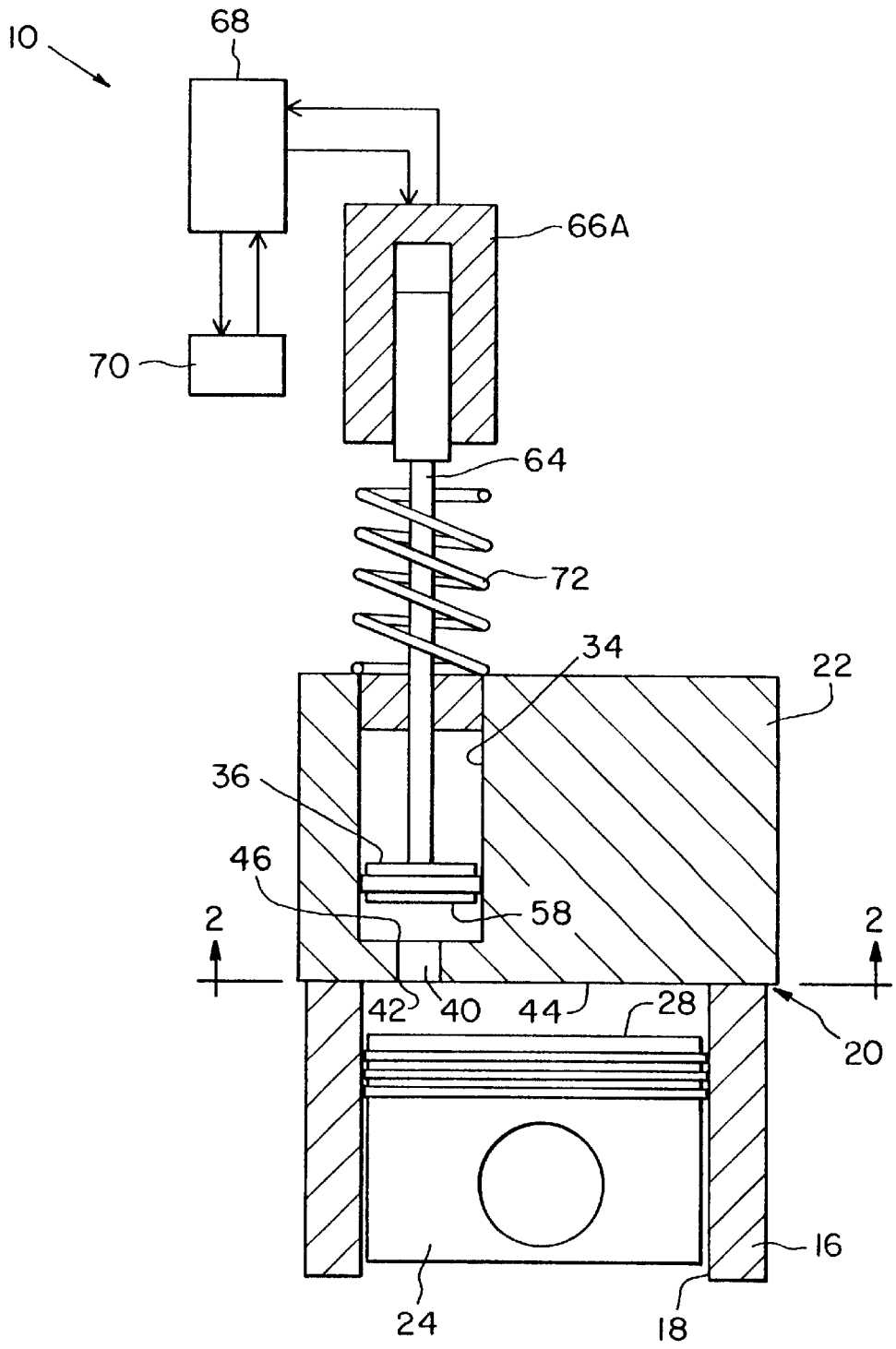
FIG. 1 is a sectional, partially fragmentary view of an embodiment of an internal combustion engine of the present invention within a work machine.
Figure 2:
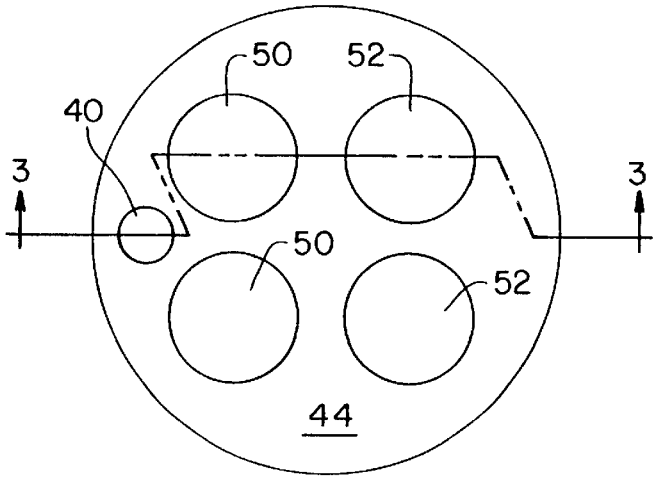
FIG. 2 is a cross-sectional view taken along line 2—2 of FIG. 1.
Figure 3:
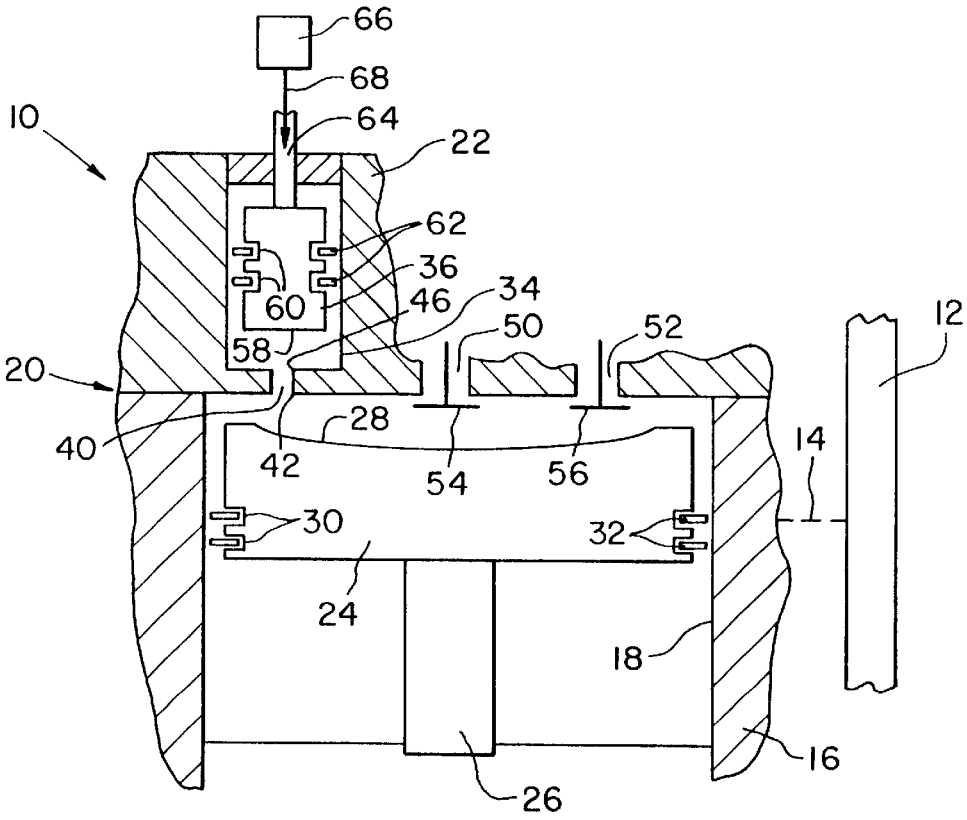
FIG. 3 is a cross-sectional view taken along line 3—3 of FIG. 2.

Referring now to the drawings, and more particularly to FIGS. 1 and 3, there is shown an embodiment of an internal combustion engine 10 of the present invention which is incorporated within a work machine such as an on-road vehicle, off-road vehicle, tractor, excavator or the like. An engine 10 according to the present invention is also suited to engines intended primarily for stationary single-speed operation installations, such as, for example, powering a generator. The work machine includes a frame 12 that carries internal combustion engine 10, as designated schematically by phantom line 14.

Engine 10 includes an engine block 16 that defines one or more combustion cylinders 18, and typically defines a plurality of combustion cylinders 18, which in preferred embodiments may be four, six, eight, twelve, sixteen or twenty combustion cylinders 18. At an end 20 of combustion cylinders 18, a head 22 is provided on block 16 above all cylinders 18.

While in most applications of the present invention a plurality of cylinders 18 are provided in engine 10, for purposes of simplicity, only one such cylinder 18 is shown in the drawings. A primary piston 24 is reciprocally disposed within combustion cylinder 18, and movable between a top dead center position adjacent head 22 (as shown in FIG. 1) and a bottom dead center position at an opposing end of combustion cylinder 18. Primary piston 24 includes a rod 26 coupled therewith on a side opposite from head 22.

Primary piston 24 also includes a crown 28 having a predefined contour that assists in mixing the fuel and air mixture which is injected into combustion cylinder 18. The particular contour of crown 28 may vary, depending on the particular application. By way of example, FIG. 1 shows a substantially flat crown 28, and FIG. 3 shows a concave crown 28. Fuel also can be provided premixed, as in a stationary natural gas engine. Primary piston 24 also includes one or more annular piston ring grooves 30 in the exterior periphery thereof, which each carry a respective piston ring 32 (FIG. 3). Piston rings 32 prevent blow-by of combustion products during a combustion cycle, as is known. Primary piston 24 may also be configured without piston ring grooves 30 and piston rings 32, depending upon the particular application.

Head 22 includes a secondary cylinder 34 that is in communication with combustion cylinder 18. A secondary piston 36 is reciprocally disposed in secondary cylinder 34. Secondary cylinder 34 communicates with combustion cylinder 18 via a communication port 40 that establishes fluid flow communication between cylinders 18 and 34. Communication port 40 has an opening 42 in a bottom deck 44 of head 22 at the top of combustion cylinder 18, and an opening 46 in secondary cylinder 34. Communication port 40 defines a passageway whereby pressure is equalized between cylinders 18 and 34. Communication port 40, particularly opening 42 thereof, is narrower in diameter than either combustion cylinder 18 or secondary cylinder 34, and is open or unrestricted between openings 42 and 46.

Head 22 also defines one or more intake ports 50, and as shown includes a pair of intake ports 50. Head 22 further defines one or more exhaust ports 52, and as shown includes two exhaust ports 52. A corresponding pair of intake valves 54 and exhaust valves 56 are reciprocally disposed in intake ports 50 and exhaust ports 52. Intake valves 54 and exhaust valves 56 are actuated in known manner during operation of internal combustion engine 10, as primary piston 24 reciprocates between the top dead center position and the bottom dead center position, and vice versa.

Secondary cylinder 34 is located at an outer area of combustion cylinder 18, and communication port 40, and particularly opening 42 thereof are located near a perimeter of combustion cylinder 18. In this regard, opening 42 and communication port 40 are generally radially outwardly of intake ports 50 and exhaust ports 52. By positioning secondary cylinder 34 near the periphery of combustion cylinders 18, and providing communication port 40 of a narrower diameter than secondary cylinder 34, a larger continuous uninterrupted area of head 22 is available for positioning and locating intake ports 50 and exhaust ports 52 in bottom deck 44 of head 22. Further, more continuous area is provided and available for positioning and locating intake valves 54 and exhaust valves 56 and the necessary operators for the movement of valves 54 and 56.

Secondary cylinder 34 is positioned adjacent combustion cylinder 18, so as to affect the fluid dynamics and chemical kinetics of the fuel and air mixture during the combustion process when primary piston 24 is at or near the top dead center position as shown in FIG. 1.

Secondary piston 36 is reciprocally disposed within secondary cylinder 34, and movable between a top dead center position adjacent combustion cylinder 18 (as shown in FIG. 1) and a bottom dead center position at an opposite end of secondary cylinder 34. Secondary piston 36 includes a crown 58 with a predefined contour, depending upon the particular application. In the embodiment shown, crown 58 is generally flat, but may also have a curved surface or compound curvature, depending upon the particular application.

Secondary piston 36 includes a pair of piston ring grooves 60 that respectively carry a pair of piston rings 62 (FIG. 3). Piston rings 62 are configured to inhibit blow-by of combustion products during combustion of the fuel and air mixture within combustion cylinder 18. A rod 64 is coupled with secondary piston 36, and is directly or indirectly coupled with an actuator 66 as indicated by line 68. Secondary piston 36 is reciprocated within secondary cylinder 34 to affect the combustion timing of the fuel and air mixture within combustion cylinder 18, as primary piston 24 reciprocates between a compression stroke and a return stroke within combustion cylinder 18.

Actuator 66 controls the reciprocating position of secondary piston 36, depending upon a position of primary piston 24. Actuator 66 may be configured as a cam actuator, a hydraulic actuator, a solenoid actuator, or other actuation device, depending upon the particular application. When configured as a cam actuator, actuator 66 includes a cam (not shown) having a flat cam profile portion which causes secondary piston 36 to remain at the top dead center position to thereby "hang" at the top dead center position for a predetermined period of time.

As indicated above, actuator 66 also may be configured as a hydraulic actuator 66A. When configured as a hydraulic actuator 66A, rod 64 thus acts as a plunger shaft for reciprocating secondary piston 36 between the top dead center position and the bottom dead center position. A hydraulic fluid source 68 is connected to actuator 66A and to a controller 70. A return spring 72 urges rod 64 and secondary piston 36 toward the bottom dead center position. When configured as a hydraulic actuator, it will be appreciated that secondary piston 36 may be moved to or through any desired location within secondary cylinder 34. Thus, the top dead center position and bottom dead center position of secondary piston 36 may vary. By varying the top dead center position of secondary piston 36, the effective compression ratio of primary piston 24 and combustion chamber 18 may likewise be varied.

In the embodiments shown, secondary piston 36 and secondary cylinder 34 each have a generally cylindrical shape (i.e., generally circular cross-sectional shape). However, depending upon the particular application, it may also be possible to configure secondary piston 36 and secondary cylinder 34 with a different cross-sectional shape while still allowing effective reciprocation of the secondary piston within the secondary cylinder.

INDUSTRIAL APPLICABILITY

During use, primary piston 24 is reciprocated within combustion cylinder 18, between the bottom dead center position and the top dead center position as shown in FIG. 1, and vice versa. As primary piston 24 moves from the bottom dead center position to the top dead center position, intake valves 54 are actuated to draw in combustion air and/or an air and fuel mixture. A separate fuel injector (not shown) may also be provided. When primary piston 24 is at or near the top dead center position, and preferably shortly before the top dead center position, secondary piston 36 is likewise actuated and moved to the top dead center position adjacent combustion cylinder 18. This effectively causes a rapid decrease in the combined volumes of combustion cylinder 18 and its associated secondary cylinder 34, communicated through communication port 40, causing rapid compression of the air/fuel mixture. Sufficient energy is imparted to the fuel and air mixture within combustion cylinder 18 to cause the fuel and air mixture to combust. Secondary piston 36 is preferably held at the top dead center position for a predetermined period of time to maintain the total volume at a minimum. When actuator 24 is constructed as a cam actuator, this is accomplished through the cam profile. When configured as a hydraulic actuator, secondary piston 36 is simply held at the top dead center position by applying sufficient hydraulic pressure to rod 64.

After combustion, primary piston 24 is moved from the top dead center position toward the bottom dead center position. Secondary piston 36 is concurrently moved toward its bottom dead center position to effectively increase the total volume communicating through communication port 40. In the case of using hydraulic actuator 24, the bottom dead center position of secondary piston 36 may also be varied to in turn vary the compression ratio of internal combustion engine 10. The process repeats for each cycle of primary piston 24 between the bottom dead center position and top dead center position, and vice versa.

As primary piston 24 moves toward the bottom dead center position, exhaust valves 56 are actuated to allow exhaust gas to exit from combustion cylinder 18.

By varying the timing of secondary piston 36, it is possible to likewise vary the timing of the combustion sequence occurring within combustion cylinder 18. Thus, it is possible to indirectly control the combustion sequence of the fuel and air mixture within combustion cylinder 18 using secondary piston 36. Control of the position of secondary piston 36 may also be a function of engine operation and conditions, such as, for example, manifold pressure, temperature or the like.

Operation of engine 10 in accordance with the present invention is fuel independent, and any conventional fuel for internal combustion engines can be used.

Other aspects, objects and advantages of this invention can be obtained from a study of the drawings, the disclosure and the appended claims.

What is claimed is:

1. An internal combustion engine, comprising:

a combustion cylinder having an end;

a primary piston reciprocally disposed within said combustion cylinder;

a cylinder head including a bottom deck disposed at said end of said combustion cylinder, said cylinder head defining a secondary cylinder having a diameter;

a secondary piston reciprocally disposed within said secondary cylinder;

an actuator coupled with said secondary piston for controlling a position of said secondary piston dependent upon a position of said primary piston, said actuator selectively controlling said position of said secondary piston to control commencement of a combustion event in said combustion cylinder; and a communication port defined in said cylinder head establishing fluid flow communication between said combustion cylinder and said secondary cylinder, said communication port including an opening in said bottom deck and an opening to said secondary cylinder, said opening in said bottom deck being narrower than said diameter of said secondary cylinder.

2. The internal combustion engine of claim 1, said actuator including one of a cam actuator, solenoid actuator and a hydraulic actuator.

3. The internal combustion engine of claim 2, said communication port disposed near a periphery of said combustion cylinder.

4. The internal combustion engine of claim 2, said cylinder head including at least one intake port and at least one exhaust port.

5. The internal combustion engine of claim 2, said cylinder head including at least two intake ports and at least two exhaust ports.

6. The internal combustion engine of claim 5, said opening in said bottom deck disposed at a perimeter of said combustion cylinder.

7. The internal combustion engine of claim 1, said communication port being unrestricted between said openings.

8. A work machine, comprising:

a frame; and an internal combustion engine carried by said frame, said internal combustion engine including:

a combustion cylinder having an end;

a primary piston reciprocally disposed within said combustion cylinder;

a cylinder head including a bottom deck at said end of said combustion cylinder, said cylinder head including a secondary cylinder having a diameter;

a secondary piston reciprocally disposed within said secondary cylinder;

an actuator coupled with said secondary piston for controlling a position of said secondary piston dependent upon a position of said primary piston, said actuator selectively controlling said position of said secondary piston to control commencement of a combustion event in said combustion cylinder; and a communication port defined in said cylinder head establishing fluid flow communication between said combustion cylinder and said secondary cylinder, said communication port having a diameter less than said diameter of said secondary cylinder.

9. The work machine of claim 8, said actuator including one of a cam actuator and a hydraulic actuator.

10. The work machine of claim 9, said communication port disposed near a periphery of said combustion cylinder.

11. The work machine of claim 8, said communication port disposed near a periphery of said combustion cylinder.

12. The work machine of claim 8, said cylinder head including an intake port and an exhaust port, and said communication port disposed in said cylinder head radially outwardly of said intake and exhaust ports.

13. The work machine of claim 8, said cylinder head including two intake ports and two exhaust ports, and said communication port disposed in said cylinder head radially outwardly of said intake and exhaust ports.

14. The work machine of claim 8, said communication port having an opening in said combustion cylinder and an opening in said secondary cylinder, each said opening being narrower than said secondary cylinder.

15. A method of operating an internal combustion engine, comprising the steps of:

reciprocating a primary piston within a combustion cylinder having an end;

reciprocating a secondary piston within a secondary cylinder adjacent said end, said reciprocating step for said secondary piston being carried out such that said secondary piston has a position within said secondary cylinder which is dependent upon a position of said primary piston within said combustion cylinder;

selectively controlling said position of said secondary piston to control commencement of a combustion event:

providing a combustable fuel to said combustion cylinder;

communicating fluid flow between said secondary cylinder and said combustion cylinder, said communicating fluid flow step being carried out through a communication port having an opening in said combustion cylinder and an opening in said secondary cylinder, each said opening being narrower than said cylinders;

16. The method of claim 15, said step of reciprocating said primary piston including moving said primary piston to a top dead center position within said combustion cylinder, and combusting a fuel and air mixture within said combustion cylinder when said primary piston is at or near said top dead center position.

17. The method of claim 16, said step of reciprocating said secondary piston including moving said secondary piston to a top dead center position within said secondary cylinder when said primary piston is at or near said corresponding top dead center position.

18. The method of claim 17, said step of reciprocating said secondary piston being carried out with a hydraulic actuator coupled with said secondary piston, said hydraulic actuator providing said primary piston and said combustion cylinder with a variable compression ratio.

19. The method of claim 15, said step of reciprocating said secondary piston being carried out with a hydraulic actuator coupled with said secondary piston, said hydraulic actuator providing said primary piston and said combustion cylinder with a variable compression ratio.

20. The method of claim 19, including the substep of holding said secondary piston at said top dead center position when said primary piston is at or near a corresponding top dead center position.

* * * * *